United States Patent [19]

Bushnell et al.

[11] 3,975,396

[45] Aug. 17, 1976

[54] DEASPHALTING PROCESS

[75] Inventors: James D. Bushnell, Berkeley Heights; Douglas G. Ryan, Livingston, both of N.J.

[73] Assignee: Exxon Research and Engineering Company, Linden, N.J.

[22] Filed: Feb. 21, 1975

[21] Appl. No.: 551,896

[52] U.S. Cl. ..... 208/309

[51] Int. Cl.[2] ..... C10G 21/14

[58] Field of Search ..... 208/309, 332, 323

[56] References Cited

UNITED STATES PATENTS

| | | | |
|---|---|---|---|
| 2,045,742 | 6/1936 | Winning et al. | 208/309 |
| 2,130,147 | 9/1938 | Milmore | 208/320 |
| 2,337,448 | 12/1943 | Carr | 208/45 |
| 2,500,757 | 3/1950 | Kiersted | 208/309 |

*Primary Examiner*—Herbert Levine

*Attorney, Agent, or Firm*—Marthe L. Gibbons; Edward M. Corcoran

[57] ABSTRACT

An asphalt-containing mineral oil is deasphalted by contacting the oil at elevated temperature and elevated pressure with a deasphalting solvent comprising acetone and a three carbon atom containing-hydrocarbon, such as propylene, for a time sufficient to remove a substantial portion of the asphaltenes from the oil. Utilization of propylene-acetone as the deasphalting solvent permits utilization of higher treating tower temperatures, which may be desirable in those instances where air cooling of the solvent is provided. This process is particularly suited for the preparation of lubricating oils of low asphalt content.

8 Claims, 3 Drawing Figures

DEASPHALTING PROCESS

BACKGROUND OF THE INVENTION

1. Field of the Invention

The present invention relates to a process for deasphalting an asphalt-containing mineral oil. More specifically, the process relates to the preparation of lubricating oils having a low asphalt content. Still more specifically, the process comprises contacting an asphalt-containing hydrocarbon feedstock with a deasphalting solvent.

2. Description of the Prior Art

Propane has been used extensively in deasphalting asphalt-containing hydrocarbon feedstocks, especially in the preparation of high quality lubricating oils. The use of propane has necessitated elaborate solvent cooling systems utilizing cold water, which is a relatively expensive cooling agent. While it is desirable to use alternative cooling equipment such as air fin coolers, this has not always been possible in the case of propane deasphalting in locations where ambient air temperature reaches about 100°F. This is due to the fact that relatively low extraction tower temperatures are required (e.g. 110°F. extraction tower bottoms temperature with an Aramco vacuum residuum) to achieve satisfactory yield and quality of deasphalted oil, thereby resulting in poor heat exchange.

Thus, attempts have been made in the past to develop a solvent system useful in deasphalting processes, which would allow operation at elevated temperatures relative to conventional propane deasphalting temperatures, thereby permitting easy heat exchange in those instances where the utilization of air-fin cooling techniques are preferred. In addition, it would be desirable to integrate dewaxing operations with deasphalting operations by having a common solvent recovery system.

Typical of prior art deasphalting processes is the process described in U.S. Pat. No. 2,337,448 in which a heavy residuum is deasphalted by contacting it at elevated temperature with a deasphalting solvent such as ethane, ethylene, propane, propylene, butane, butylene, isobutane, and mixtures thereof. In the process of this patent may be utilized such other solvents as pentane, gasoline, mixtures of alcohol and ether, acetone and other solvents capable of dissolving the oil and resins but not the asphaltenes.

SUMMARY OF THE INVENTION

In accordance with the invention, there is provided a process for deasphalting an asphalt-containing mineral oil, which comprises: contacting said mineral oil at elevated temperature and elevated pressure with a deasphalting three carbon atom-containing hydrocarbon selected from the group consisting of propylene, propane and mixtures thereof, in combination with acetone in an amount ranging from about 2 to about 25 liquid volume percent (based on the total solvent).

The process is particularly useful in deasphalting residual petroleum oil fractions for the production of high viscosity lubricating oils generally referred to as "bright stock".

The deasphalting solvent of the present invention preferably comprises propylene in combination with acetone. It is to be understood that besides said three carbon containing hydrocarbons, minor amounts of other hydrocarbons may be present in the solvent without substantially affecting the overall efficiency of the process. Preferably, the $C_3$ hydrocarbon component will be present in an amount of at least 95 liquid volume percent (LV%) of the total hydrocarbons or 95 LV% of the 98 to 75 LV% remaining balance of the total deasphalting solvent. The amount of deasphalting solvent employed and the operating temperatures and pressures utilized must be controlled to suit the particular solvent composition and the oil feedstock being treated to obtain a deasphalted oil of the desired viscosity and Conradson carbon residue content. In general, from about 4 to about 10 volumes of deasphalting solvent are mixed with the oil, preferably from about 6 about 8 volumes of solvent.

The contacting step takes place at a temperature ranging from about 110° to about 200°F., preferably from about 135° to about 190°F. and at a pressure ranging from about 450 to about 650 pounds per square inch gauge (psig), preferably from about 550 to about 600 psig. The overall contacting operation results in the formation of two layers, an upper layer of viscous oil dissolved in the solvent and a lower layer of asphaltenes containing some oil and solvent. The upper layer is withdrawn from the asphaltene layer and then each layer is subjected to flash vaporization and stripping to remove the solvent from the deasphalted oil and asphalt byproducts.

The process of the invention is suitable for removing asphalt from any mineral oil feedstock containing asphaltenes. Suitable mineral oil feedstocks include residual petroleum oil fractions having initial boiling points (at atmospheric pressure) ranging from about 650° to about 1,100°F. It is particularly suited for treating atmospheric residua and vacuum residua. Preferably the oil feedstock treated is a petroleum vacuum residuum having an initial atmospheric boiling point ranging from about 950° to about 1,050°F., a gravity of about 5° to 15° API and a viscosity ranging from about 500 to about 30,000 SSU/210°F. The contacting of the mineral oil feed with the deasphalting solvent may be carried out in one or more mixer-settler units or in a countercurrent liquid-liquid contacting tower. In the latter case, the mineral oil feed enters the top of the tower and the deasphalting solvent enters near the bottom. The tower is provided with internals such as packing, staggered rows of angle irons or liquid-liquid contacting trays to provide efficient contacting of the two liquid phases. The asphalt phase passes through the tower, countercurrently to the bulk of the rising solvent stream and leaves the bottom of the tower. The solvent stream containing the dissolved deasphalted oil, passes by the feed stage and then usually through a zone provided with heating coil to reject some of the heavier components in the oil and to promote reflux. It should be noted that with the deasphalting solvent of the present invention, as is typical with most deasphalting solvents, the solubility of the dissolved deasphalted oil is reduced as the temperature increases. This is contrary to the nature of most other types of solvent extraction processes wherein the solubility of the extract in the solvent increases with increasing temperature.

DESCRIPTION OF THE PREFERRED EMBODIMENTS

The preferred embodiments will be described with reference to the figures.

Figure 1:
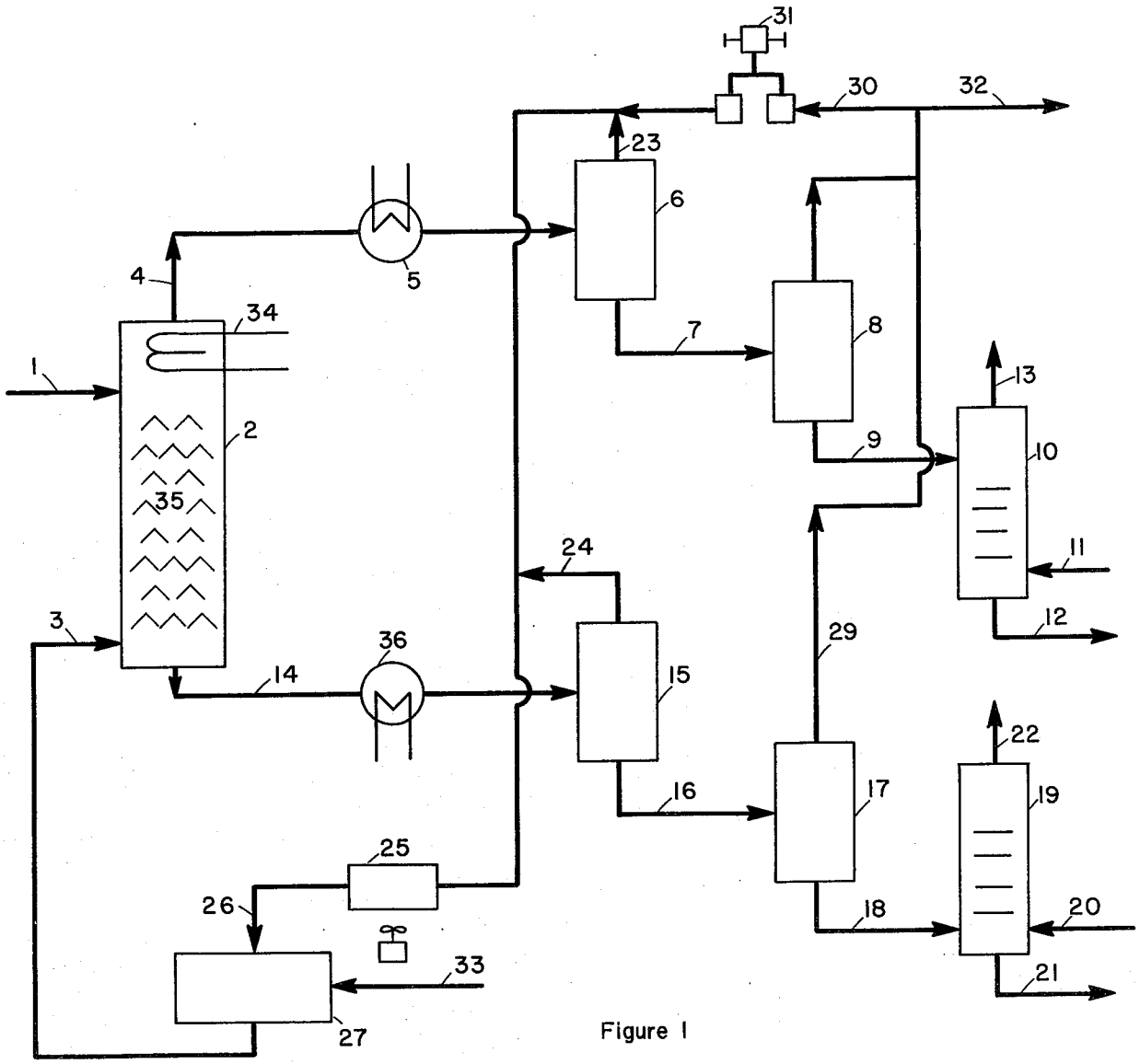
FIG. 1 is a schematic flow plan of an embodiment of the invention.

Referring to FIG. 1, a vacuum residuum feed of 4.9° API gravity at a typical temperature of 200° to 250°F. enters via line 1 into a countercurrent deasphalting tower 2 near the top and flows down over contacting means such as staggered rows of angle irons 35, while being contacted with propylene-acetone deasphalting solvent entering the tower near the bottom via line 3. The propylene-acetone solvent comprises 96 LV% propylene and 4 LV% acetone, and the treat rate is 800 LV% on feed. The tower bottom temperature is 170°F. and the tower top temperature is 190°F. because of the hotter feedstock entering near the top and because of additional heat input above the feed point introduced by steam heating coil 34. The deasphalted oil phase 4 leaving the top of the tower is heated by heating means 5 to a temperature of about 300°–350°F. at a pressure of about 350 to about 500 psig whereupon most of the solvent is flashed off in high pressure flash tower 6. Bottoms from the tower, containing small amounts of propylene and acetone, pass through line 7 to low pressure flash tower 8 where most of the remaining solvent flashes off. The bottoms from the tower pass through line 9 to stripper 10 where the bottoms are stripped with steam entering through line 11 to correct the explosivity by removing all traces of solvent. The final stripped deasphalted oil product goes out to storage via line 12.

The asphalt phase leaves the bottom of the deasphalting tower 2 via line 14 to heater 36 where it is heated to about 550° to 600°F. at a pressure of 530 to 500 psig, and the bulk of the solvent is flashed off in high pressure flash tower 15. Bottoms from this tower are passed via line 16 to low pressure flash tower 17 where most of the remaining solvent is flashed off at near atmospheric pressure. The bottoms from the low pressure flash, containing only traces of solvent, proceed via line 18 to stripper 19 where they are stripped with steam entering via line 20. The stripped asphalt by-product leaves the unit via line 21.

Overhead solvent vapor from high pressure flash tower 6 leaves via line 23 and is combined with a vapor from high pressure flash tower 15 via line 24 and proceeds to air fin condenser 25 where it is condensed. Liquid solvent flows via line 26 into solvent surge drum 27 from which it is recycled via line 3 to the deasphalting tower.

Overhead solvent vapor from low pressure deasphalted oil flash tower 8 leaves via line 28 and a portion thereof is combined with vapor from low pressure asphalt flash tower 17 leaving via line 29 and proceeds to compressor 31 via line 30. The compressor discharge is combined with the overhead from high pressure flash towers 6 and 15 and proceeds via air fin condenser 25 to the solvent surge drum 27. If desired, the solvent vapor from the low pressure flash towers 8 and 17 may be sent to a compressor of a dewaxing plant (not shown) using also propylene-acetone solvent as dewaxing solvent, and the condensed liquid solvent make up returned from the dewaxing plant to the deasphalting solvent surge drum 27 via line 33. Incremental capacity in the dewaxing compressor is less costly than providing a separate compressor 31 in the deasphalter.

Overhead vapors from the deasphalted oil stripper 10 and asphalt stripper 19 are mixtures of stripper steam and traces of propylene and acetone. They leave, respectively, via lines 13 and 22 and may be disposed by burning in a process furnace of flare or the steam condensed and the trace amounts of propylene and acetone recovered in the facilities normally provided in a propylene-acetone dewaxing plant (comprising a decanting drum and a deketonizing tower).

For the above-described specific embodiment, it is estimated that a deasphalted oil of lubricating oil quality having a gravity of 19.9° API is obtainable in amounts of about 23 LV% of the residuum feed.

The following example is presented to further illustrate the invention.

EXAMPLE

Figure 2:
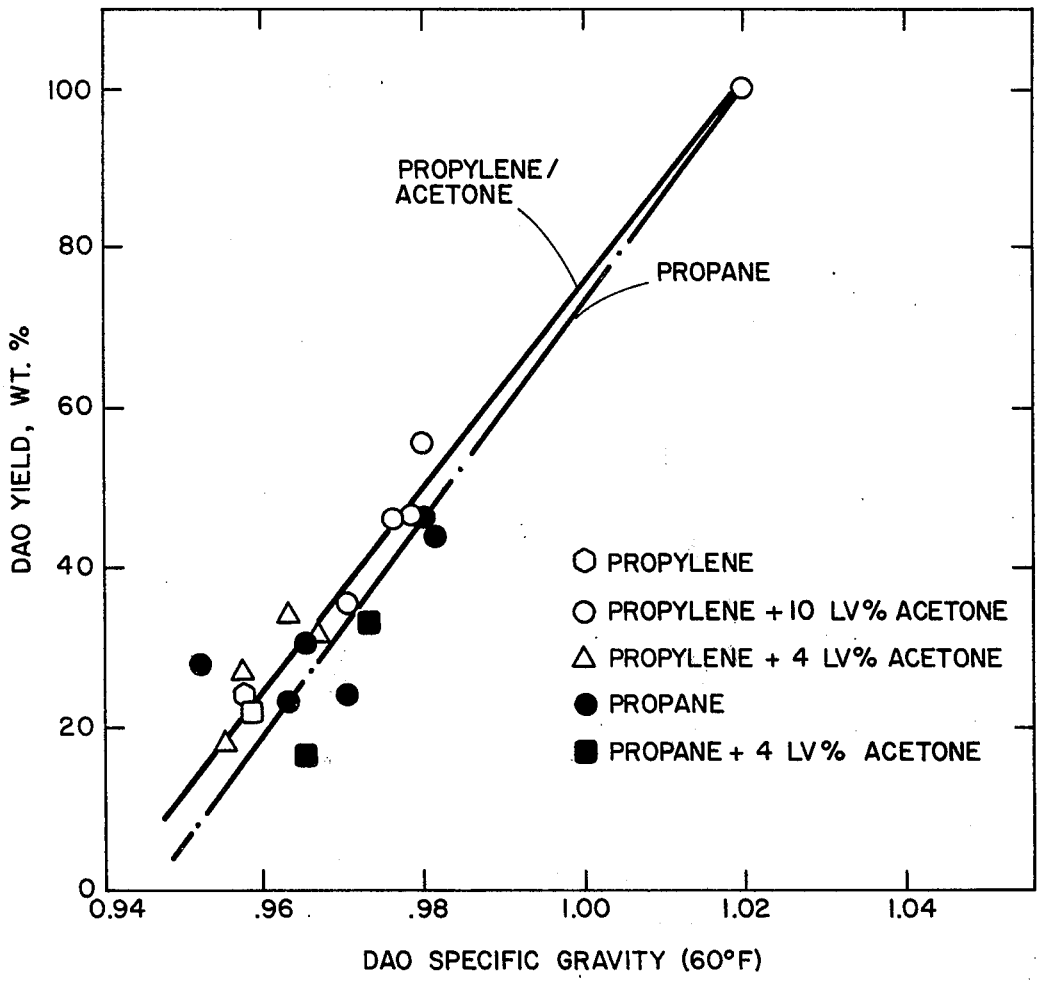
FIG. 2 is a graph showing yield-gravity relationships for various deasphalted feedstocks.

Several experiments were conducted to determine the quality and yield of deasphalted oil obtained in propylene-acetone deasphalting relative to propane deasphalting of an Aramco vacuum residuum of 1.02 specific gravity. In the course of these experiments, a single stage batch bomb comprising 70 cubic centimeter volume was utilized. A propylene-acetone solvent-/oil ratio of 8:1 (by volume) was utilized. The solvents comprised from 4 to 10 LV% acetone dissolved in the propylene. Comparative runs were made on the same Aramco vacuum residuum with propane solvent. Because of the small samples of deasphalted oil obtained in these experiments, the main criterion of product quality was the specific gravity of the deasphalted oil. The data are plotted in FIG. 2. Although the data are somewhat scattered, the results show that the propylene-acetone solvent gives a deasphalted oil yield at least equal to that of propane at a given quality, and possibly slightly higher. Another more qualitative test made was the asphaltene spot test, which is carried out by allowing a drop of hot deasphalted oil to flow onto a piece of filter paper. Asphaltenes present in the oil remain as a black spot at the point where the oil flows onto the paper, while the oil diffuses out through the paper. The size of the black spot is a qualitative measure of the asphaltene content of the oil. In these tests, deasphalted oil (DAO) samples from propylene-acetone deasphalting showed a lower asphaltene content than those from propane at a given yield. These data indicate that propylene-acetone not only allows more convenient operting conditions but also gives equal or better selectivity than the conventional propane deasphalting solvent.

Figure 3:
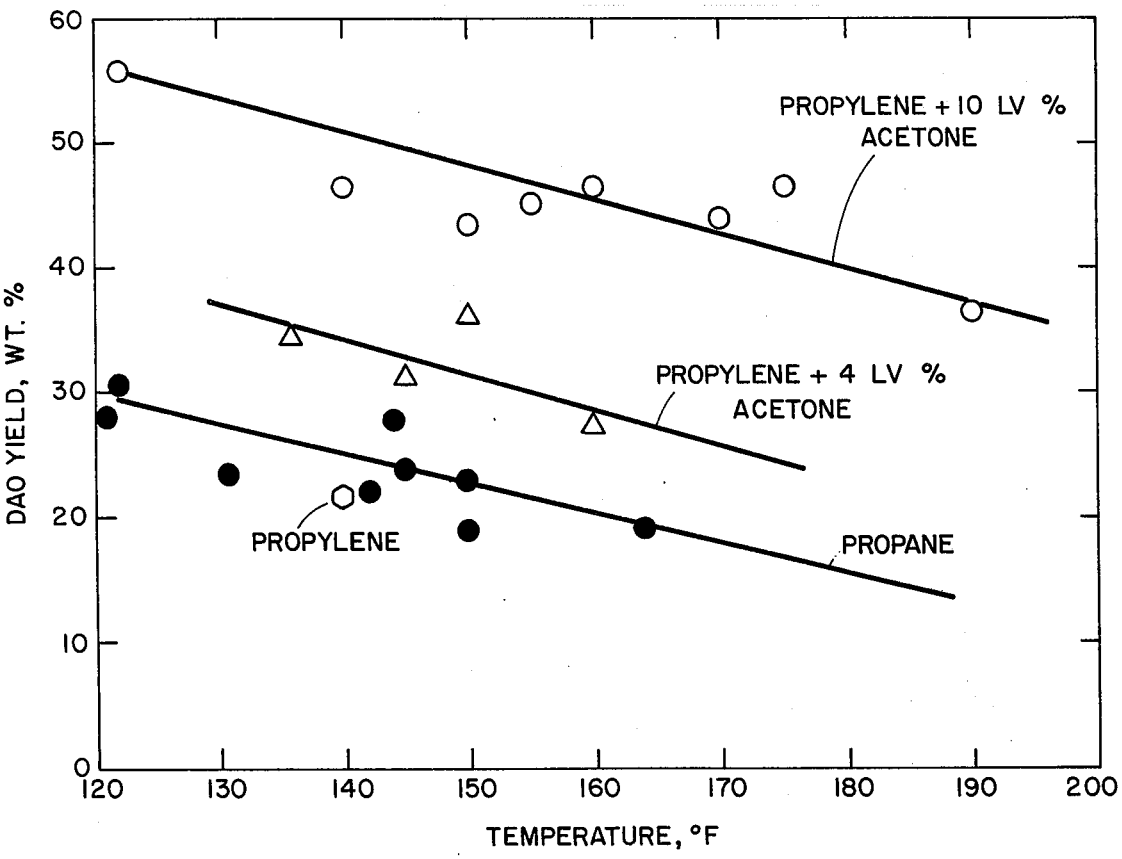
FIG. 3 relates the effect of extraction temperature to overall deasphalted oil yield.

In FIG. 3, the yields of deasphalted oil are plotted versus operating temperatures in the bomb for propylene containing, respectively, 4 LV% and 10 LV% acetone, as well as for propane alone and propylene alone. It may be seen that for this particular residuum feed, propylene containing only 4 LV% acetone gave the same deasphalted oil yield as propane at about 35°F. higher operating temperature. Propylene with 10 LV% acetone could give the same yield at about 100°F. higher operating temperature than propane. Thus, by controlling the acetone content of the solvent over a narrow range, a desired range of operating temperatures in the deasphalting tower can be achieved to accommodate minimum cost equipment in the plant.

What is claimed is:

1. A process for deasphalting an asphalt-containing mineral oil, which comprises: contacting said mineral oil at elevated temperature and elevated pressure with a deasphalting solvent consisting essentially of propylene containing from about 2 to 25 LV% of acetone to form two layers, an upper layer of viscous oil dissolved in the solvent and a lower layer of asphaltenes containing some oil and solvent, separating the upper layer from the lower layer and recovering a deasphalted oil from the upper layer.

2. The process of claim 1, wherein said contacting step is conducted at a temperature ranging from about 110° to a obout 200°F. at a pressure ranging from about 450 to about 650 psig at a solvent to oil ratio ranging from about 10:1 to 4:1.

3. The process of claim 1, wherein said mineral oil is a petroleum oil having an initial atmospheric boiling point ranging from about 650° to about 1,100°F.

4. The process of claim 3, wherein said petroleum oil is a vacuum residdum having an initial atmospheric boiling point ranging from about 950° to about 1,050°F.

5. A deasphalting process which comprises contacting a heavy mineral oil containing asphaltenes with a deasphalting solvent consisting essentially of propylene containing from about 2 to about 25 LV% acetone at a temperature ranging from about 110 to about 200°and at a pressure ranging from about 450 to about 650 psig for a period of time sufficient to form two layers, an upper layer of viscous oil dissolved in the solvent and a lower layer of asphaltenes containing some oil and solvent, separating the upper layer from the lower layer and recovering a deasphalted oil from the upper layer.

6. The process of claim 5, wherein said heavy mineral oil is a petroleum vacuum residuum having an initial atmospheric boiling point above about 950°F.

7. The process of claim 4 wherein said contacting step is conducted at a temperature ranging from about 135° to 190°F.

8. The process of claim 6 wherein the contacting step is conducted at temperature ranging from about 135° to 190°F and at a pressure ranging from about 550 to 600 psig.

* * * * *